US007492339B2

(12) United States Patent
Amundson

(10) Patent No.: US 7,492,339 B2
(45) **Date of Patent: *Feb. 17, 2009**

(54) METHODS FOR DRIVING BISTABLE ELECTRO-OPTIC DISPLAYS

(75) Inventor: Karl R. Amundson, Cambridge, MA (US)

(73) Assignee: E Ink Corporation, Cambridge, MA (US)

( * ) Notice: Subject to any disclaimer, the term of this patent is extended or adjusted under 35 U.S.C. 154(b) by 589 days.

This patent is subject to a terminal disclaimer.

(21) Appl. No.: 10/906,985

(22) Filed: Mar. 15, 2005

(65) Prior Publication Data

US 2005/0212747 A1 Sep. 29, 2005

Related U.S. Application Data

(60) Provisional application No. 60/557,094, filed on Mar. 26, 2004, provisional application No. 60/560,420, filed on Apr. 8, 2004.

(51) Int. Cl.
*G09G 3/36* (2006.01)

(52) U.S. Cl. ..... 345/87; 345/105

(58) Field of Classification Search ..... 345/87, 345/105, 690

See application file for complete search history.

(56) References Cited

U.S. PATENT DOCUMENTS

| | | | |
|---|---|---|---|
| 3,668,106 | A | 6/1972 | Ota |
| 3,756,693 | A | 9/1973 | Ota |
| 3,767,392 | A | 10/1973 | Ota |
| 3,792,308 | A | 2/1974 | Ota |
| 3,870,517 | A | 3/1975 | Ota et al. |
| 3,892,568 | A | 7/1975 | Ota |
| 3,972,040 | A | 7/1976 | Hilsum et al. |
| 4,041,481 | A | 8/1977 | Sato |
| 4,418,346 | A | 11/1983 | Batchelder |
| 4,430,648 | A | 2/1984 | Togashi et al. |
| 4,450,440 | A | 5/1984 | White |
| 4,741,604 | A | 5/1988 | Kornfeld |

(Continued)

FOREIGN PATENT DOCUMENTS

| | | |
|---|---|---|
| DE | 25 23 763 | 12/1976 |

(Continued)

OTHER PUBLICATIONS

Amundson, K., "Electrophoretic Imaging Films for Electronic Paper Displays" in Crawford, G. ed. Flexible Flat Panel Displays, John Wiley & Sons, Ltd., Hoboken, NJ: 2005.

(Continued)

*Primary Examiner*—Richard Hjerpe
*Assistant Examiner*—Shaheda A Abdin
(74) *Attorney, Agent, or Firm*—David J. Cole

(57) ABSTRACT

A bistable electro-optic display having at least one pixel is driven using a waveform V(t) such that:

$$J = \int_0^T V(t)M(T-t)dt$$

(where T is the length of the waveform, the integral is over the duration of the waveform, V(t) is the waveform voltage as a function of time t, and M(t) is a memory function that characterizes the reduction in efficacy of the remnant voltage to induce dwell-time-dependence arising from a short pulse at time zero) is less than about 1 volt sec.

23 Claims, 3 Drawing Sheets

U.S. PATENT DOCUMENTS

| | | | | |
|---|---|---|---|---|
| 4,746,917 | A | 5/1988 | DiSanto et al. | |
| 4,833,464 | A | 5/1989 | DiSanto et al. | |
| 4,947,157 | A | 8/1990 | DiSanto et al. | |
| 4,947,159 | A | 8/1990 | DiSanto et al. | |
| 5,010,327 | A | 4/1991 | Wakita et al. | |
| 5,066,946 | A | 11/1991 | DiSanto et al. | |
| 5,068,816 | A * | 11/1991 | Noetzel | 708/270 |
| 5,177,475 | A | 1/1993 | Stephany et al. | |
| 5,223,115 | A | 6/1993 | DiSanto et al. | |
| 5,247,290 | A | 9/1993 | DiSanto et al. | |
| 5,254,981 | A | 10/1993 | Disanto et al. | |
| 5,266,937 | A | 11/1993 | DiSanto et al. | |
| 5,293,528 | A | 3/1994 | DiSanto et al. | |
| 5,296,953 | A * | 3/1994 | Kanbe et al. | 349/37 |
| 5,302,235 | A | 4/1994 | DiSanto et al. | |
| 5,412,398 | A | 5/1995 | DiSanto et al. | |
| 5,467,107 | A | 11/1995 | DiSanto et al. | |
| 5,467,217 | A | 11/1995 | Check, III | |
| 5,499,038 | A | 3/1996 | DiSanto et al. | |
| 5,654,732 | A | 8/1997 | Katakura | |
| 5,684,501 | A | 11/1997 | Knapp et al. | |
| 5,689,282 | A | 11/1997 | Wolfs et al. | |
| 5,717,515 | A | 2/1998 | Sheridon | |
| 5,739,801 | A | 4/1998 | Sheridon | |
| 5,745,094 | A | 4/1998 | Gordon, II et al. | |
| 5,760,761 | A | 6/1998 | Sheridon | |
| 5,777,782 | A | 7/1998 | Sheridon | |
| 5,808,783 | A | 9/1998 | Crowley | |
| 5,872,552 | A | 2/1999 | Gordon, II et al. | |
| 5,892,504 | A | 4/1999 | Knapp | |
| 5,896,117 | A | 4/1999 | Moon | |
| 5,930,026 | A | 7/1999 | Jacobson et al. | |
| 5,933,203 | A | 8/1999 | Wu et al. | |
| 5,961,804 | A | 10/1999 | Jacobson et al. | |
| 5,963,456 | A | 10/1999 | Klein et al. | |
| 5,978,052 | A | 11/1999 | Ilcisin et al. | |
| 6,002,384 | A | 12/1999 | Tamai et al. | |
| 6,017,584 | A | 1/2000 | Albert et al. | |
| 6,034,807 | A | 3/2000 | Little et al. | |
| 6,054,071 | A | 4/2000 | Mikkelsen, Jr. | |
| 6,055,091 | A | 4/2000 | Sheridon et al. | |
| 6,055,180 | A | 4/2000 | Gudesen et al. | |
| 6,057,814 | A | 5/2000 | Kalt | |
| 6,064,410 | A | 5/2000 | Wen et al. | |
| 6,067,185 | A | 5/2000 | Albert et al. | |
| 6,081,285 | A | 6/2000 | Wen et al. | |
| 6,097,531 | A | 8/2000 | Sheridon | |
| 6,118,426 | A | 9/2000 | Albert et al. | |
| 6,120,588 | A | 9/2000 | Jacobson | |
| 6,120,839 | A | 9/2000 | Comiskey et al. | |
| 6,124,851 | A | 9/2000 | Jacobson | |
| 6,128,124 | A | 10/2000 | Silverman | |
| 6,130,773 | A | 10/2000 | Jacobson et al. | |
| 6,130,774 | A | 10/2000 | Albert et al. | |
| 6,137,467 | A | 10/2000 | Sheridon et al. | |
| 6,144,361 | A | 11/2000 | Gordon, II et al. | |
| 6,147,791 | A | 11/2000 | Sheridon | |
| 6,154,190 | A | 11/2000 | Yang et al. | |
| 6,172,798 | B1 | 1/2001 | Albert et al. | |
| 6,177,921 | B1 | 1/2001 | Comiskey et al. | |
| 6,184,856 | B1 | 2/2001 | Gordon, II et al. | |
| 6,211,998 | B1 | 4/2001 | Sheridon | |
| 6,225,971 | B1 | 5/2001 | Gordon, II et al. | |
| 6,232,950 | B1 | 5/2001 | Albert et al. | |
| 6,236,385 | B1 | 5/2001 | Nomura et al. | |
| 6,239,896 | B1 | 5/2001 | Ikeda | |
| 6,241,921 | B1 | 6/2001 | Jacobson et al. | |
| 6,249,271 | B1 | 6/2001 | Albert et al. | |
| 6,252,564 | B1 | 6/2001 | Albert et al. | |
| 6,262,706 | B1 | 7/2001 | Albert et al. | |
| 6,262,833 | B1 | 7/2001 | Loxley et al. | |
| 6,271,823 | B1 | 8/2001 | Gordon, II et al. | |
| 6,300,932 | B1 | 10/2001 | Albert | |
| 6,301,038 | B1 | 10/2001 | Fitzmaurice et al. | |
| 6,312,304 | B1 | 11/2001 | Duthaler et al. | |
| 6,312,971 | B1 | 11/2001 | Amundson et al. | |
| 6,320,565 | B1 | 11/2001 | Albu et al. | |
| 6,323,989 | B1 | 11/2001 | Jacobson et al. | |
| 6,327,072 | B1 | 12/2001 | Comiskey et al. | |
| 6,330,054 | B1 | 12/2001 | Ikami | |
| 6,348,908 | B1 | 2/2002 | Richley et al. | |
| 6,359,605 | B1 | 3/2002 | Knapp et al. | |
| 6,373,461 | B1 | 4/2002 | Hasegawa et al. | |
| 6,376,828 | B1 | 4/2002 | Comiskey | |
| 6,377,387 | B1 | 4/2002 | Duthaler et al. | |
| 6,392,785 | B1 | 5/2002 | Albert et al. | |
| 6,392,786 | B1 | 5/2002 | Albert | |
| 6,407,763 | B1 | 6/2002 | Yamaguchi et al. | |
| 6,413,790 | B1 | 7/2002 | Duthaler et al. | |
| 6,421,033 | B1 | 7/2002 | Williams et al. | |
| 6,422,687 | B1 | 7/2002 | Jacobson | |
| 6,445,374 | B2 | 9/2002 | Albert et al. | |
| 6,445,489 | B1 | 9/2002 | Jacobson et al. | |
| 6,459,418 | B1 | 10/2002 | Comiskey et al. | |
| 6,462,837 | B1 | 10/2002 | Tone | |
| 6,473,072 | B1 | 10/2002 | Comiskey et al. | |
| 6,480,182 | B2 | 11/2002 | Turner et al. | |
| 6,498,114 | B1 | 12/2002 | Amundson et al. | |
| 6,504,524 | B1 * | 1/2003 | Gates et al. | 345/107 |
| 6,506,438 | B2 | 1/2003 | Duthaler et al. | |
| 6,512,354 | B2 | 1/2003 | Jacobson et al. | |
| 6,515,649 | B1 | 2/2003 | Albert et al. | |
| 6,518,949 | B2 | 2/2003 | Drzaic | |
| 6,521,489 | B2 | 2/2003 | Duthaler et al. | |
| 6,531,997 | B1 | 3/2003 | Gates et al. | |
| 6,535,197 | B1 | 3/2003 | Comiskey et al. | |
| 6,538,801 | B2 | 3/2003 | Jacobson et al. | |
| 6,545,291 | B1 | 4/2003 | Amundson et al. | |
| 6,580,545 | B2 | 6/2003 | Morrison et al. | |
| 6,639,578 | B1 | 10/2003 | Comiskey et al. | |
| 6,652,075 | B2 | 11/2003 | Jacobson | |
| 6,657,772 | B2 | 12/2003 | Loxley | |
| 6,664,944 | B1 | 12/2003 | Albert et al. | |
| D485,294 | S | 1/2004 | Albert | |
| 6,672,921 | B1 | 1/2004 | Liang et al. | |
| 6,680,725 | B1 | 1/2004 | Jacobson | |
| 6,683,333 | B2 | 1/2004 | Kazlas et al. | |
| 6,693,620 | B1 | 2/2004 | Herb et al. | |
| 6,704,133 | B2 | 3/2004 | Gates et al. | |
| 6,710,540 | B1 | 3/2004 | Albert et al. | |
| 6,721,083 | B2 | 4/2004 | Jacobson et al. | |
| 6,724,519 | B1 | 4/2004 | Comiskey et al. | |
| 6,727,881 | B1 | 4/2004 | Albert et al. | |
| 6,738,050 | B2 | 5/2004 | Comiskey et al. | |
| 6,750,473 | B2 | 6/2004 | Amundson et al. | |
| 6,753,999 | B2 | 6/2004 | Zehner et al. | |
| 6,788,449 | B2 | 9/2004 | Liang et al. | |
| 6,816,147 | B2 | 11/2004 | Albert | |
| 6,819,471 | B2 | 11/2004 | Amundson et al. | |
| 6,822,782 | B2 | 11/2004 | Honeyman et al. | |
| 6,825,068 | B2 | 11/2004 | Denis et al. | |
| 6,825,829 | B1 | 11/2004 | Albert et al. | |
| 6,825,970 | B2 | 11/2004 | Goenaga et al. | |
| 6,831,769 | B2 | 12/2004 | Holman et al. | |
| 6,839,158 | B2 | 1/2005 | Albert et al. | |
| 6,842,167 | B2 | 1/2005 | Albert et al. | |
| 6,842,279 | B2 | 1/2005 | Amundson | |
| 6,842,657 | B1 | 1/2005 | Drzaic et al. | |
| 6,864,875 | B2 | 3/2005 | Drzaic et al. | |
| 6,865,010 | B2 | 3/2005 | Duthaler et al. | |
| 6,866,760 | B2 | 3/2005 | Paolini Jr. et al. | |
| 6,870,657 | B1 | 3/2005 | Fitzmaurice et al. | |
| 6,870,661 | B2 | 3/2005 | Pullen et al. | |
| 6,900,851 | B2 | 5/2005 | Morrison et al. | |

| | | | |
|---|---|---|---|
| 6,922,276 | B2 | 7/2005 | Zhang et al. |
| 6,950,220 | B2 | 9/2005 | Abramson et al. |
| 6,958,848 | B2 | 10/2005 | Cao et al. |
| 6,967,640 | B2 | 11/2005 | Albert et al. |
| 6,980,196 | B1 | 12/2005 | Turner et al. |
| 6,982,178 | B2 | 1/2006 | LeCain et al. |
| 6,987,603 | B2 | 1/2006 | Paolini, Jr. et al. |
| 6,995,550 | B2 | 2/2006 | Jacobson et al. |
| 7,002,728 | B2 | 2/2006 | Pullen et al. |
| 7,012,600 | B2 | 3/2006 | Zehner et al. |
| 7,012,735 | B2 | 3/2006 | Honeyman et al. |
| 7,023,420 | B2 | 4/2006 | Comiskey et al. |
| 7,030,412 | B1 | 4/2006 | Drzaic et al. |
| 7,030,854 | B2 | 4/2006 | Baucom et al. |
| 7,034,783 | B2 | 4/2006 | Gates et al. |
| 7,038,655 | B2 | 5/2006 | Herb et al. |
| 7,119,772 | B2 * | 10/2006 | Amundson et al. ..... 345/87 |
| 2001/0026260 | A1 | 10/2001 | Yoneda et al. |
| 2002/0005832 | A1 | 1/2002 | Katase |
| 2002/0033784 | A1 | 3/2002 | Machida et al. |
| 2002/0033793 | A1 | 3/2002 | Machida et al. |
| 2002/0060321 | A1 | 5/2002 | Kazlas et al. |
| 2002/0090980 | A1 | 7/2002 | Wilcox et al. |
| 2002/0113770 | A1 | 8/2002 | Jacobson et al. |
| 2002/0180687 | A1 * | 12/2002 | Webber ..... 345/107 |
| 2002/0196207 | A1 | 12/2002 | Machida et al. |
| 2002/0196219 | A1 | 12/2002 | Matsunaga et al. |
| 2003/0011560 | A1 | 1/2003 | Albert et al. |
| 2003/0058223 | A1 | 3/2003 | Tracy et al. |
| 2003/0063076 | A1 | 4/2003 | Machida et al. |
| 2003/0102858 | A1 | 6/2003 | Jacobson et al. |
| 2003/0151702 | A1 | 8/2003 | Morrison et al. |
| 2003/0222315 | A1 | 12/2003 | Amundson et al. |
| 2004/0014265 | A1 | 1/2004 | Kazlas et al. |
| 2004/0051934 | A1 | 3/2004 | Machida et al. |
| 2004/0075634 | A1 | 4/2004 | Gates |
| 2004/0094422 | A1 | 5/2004 | Pullen et al. |
| 2004/0105036 | A1 | 6/2004 | Danner et al. |
| 2004/0112750 | A1 | 6/2004 | Jacobson et al. |
| 2004/0119681 | A1 | 6/2004 | Albert et al. |
| 2004/0120024 | A1 | 6/2004 | Chen et al. |
| 2004/0136048 | A1 | 7/2004 | Arango et al. |
| 2004/0155857 | A1 | 8/2004 | Duthaler et al. |
| 2004/0180476 | A1 | 9/2004 | Kazlas et al. |
| 2004/0190114 | A1 | 9/2004 | Jacobson et al. |
| 2004/0190115 | A1 | 9/2004 | Liang et al. |
| 2004/0196215 | A1 | 10/2004 | Duthaler et al. |
| 2004/0226820 | A1 | 11/2004 | Webber et al. |
| 2004/0239614 | A1 | 12/2004 | Amundson et al. |
| 2004/0246562 | A1 | 12/2004 | Chung et al. |
| 2004/0252360 | A1 | 12/2004 | Webber et al. |
| 2004/0257635 | A1 | 12/2004 | Paolini, Jr. et al. |
| 2004/0263947 | A1 | 12/2004 | Drzaic et al. |
| 2005/0001810 | A1 | 1/2005 | Yakushiji et al. |
| 2005/0001812 | A1 | 1/2005 | Amundson et al. |
| 2005/0007336 | A1 | 1/2005 | Albert et al. |
| 2005/0012980 | A1 | 1/2005 | Wilcox et al. |
| 2005/0017944 | A1 | 1/2005 | Albert |
| 2005/0018273 | A1 | 1/2005 | Honeyman et al. |
| 2005/0024353 | A1 | 2/2005 | Amundson et al. |
| 2005/0035941 | A1 | 2/2005 | Albert et al. |
| 2005/0062714 | A1 | 3/2005 | Zehner et al. |
| 2005/0067656 | A1 | 3/2005 | Denis et al. |
| 2005/0078099 | A1 | 4/2005 | Amundson et al. |
| 2005/0105159 | A1 | 5/2005 | Paolini, Jr. et al. |
| 2005/0105162 | A1 | 5/2005 | Paolini, Jr. et al. |
| 2005/0122284 | A1 | 6/2005 | Gates et al. |
| 2005/0122306 | A1 | 6/2005 | Wilcox et al. |
| 2005/0122563 | A1 | 6/2005 | Honeyman et al. |
| 2005/0122564 | A1 | 6/2005 | Zehner et al. |
| 2005/0122565 | A1 | 6/2005 | Doshi et al. |
| 2005/0134554 | A1 | 6/2005 | Albert et al. |
| 2005/0151709 | A1 | 7/2005 | Jacobson et al. |
| 2005/0152022 | A1 | 7/2005 | Honeyman et al. |
| 2005/0156340 | A1 | 7/2005 | Valianatos et al. |
| 2005/0168799 | A1 | 8/2005 | Whitesides et al. |
| 2005/0168801 | A1 | 8/2005 | O'Neil et al. |
| 2005/0179642 | A1 | 8/2005 | Wilcox et al. |
| 2005/0190137 | A1 | 9/2005 | Duthaler et al. |
| 2005/0270261 | A1 | 12/2005 | Danner et al. |

FOREIGN PATENT DOCUMENTS

| | | | |
|---|---|---|---|
| EP | 1 099 207 | B1 | 3/2002 |
| EP | 1 145 072 | B1 | 5/2003 |
| EP | 1 462 847 | | 9/2004 |
| EP | 1 482 354 | | 12/2004 |
| EP | 1 484 635 | | 12/2004 |
| EP | 1 500 971 | A1 | 1/2005 |
| EP | 1 501 194 | A1 | 1/2005 |
| EP | 1 536 271 | | 6/2005 |
| EP | 1 542 067 | | 6/2005 |
| EP | 1 577 702 | | 9/2005 |
| EP | 1 577 703 | | 9/2005 |
| EP | 1 598 694 | | 11/2005 |
| JP | 03-091722 | A | 4/1991 |
| JP | 03-096925 | A | 4/1991 |
| JP | 05-173194 | A | 7/1993 |
| JP | 06-233131 | A | 8/1994 |
| JP | 09-016116 | A | 1/1997 |
| JP | 09-185087 | A | 7/1997 |
| JP | 09-230391 | A | 9/1997 |
| JP | 11-113019 | A | 4/1999 |
| WO | WO 99/10870 | | 3/1999 |
| WO | WO 00/36560 | | 6/2000 |
| WO | WO 00/38000 | | 6/2000 |
| WO | WO 00/67110 | | 11/2000 |
| WO | WO 01/07961 | | 2/2001 |
| WO | WO 2004/001498 | | 12/2003 |
| WO | WO 2004/079442 | | 9/2004 |
| WO | WO 2004/090626 | | 10/2004 |
| WO | WO 2004/107031 | | 12/2004 |
| WO | WO 2005/094519 | | 10/2005 |

OTHER PUBLICATIONS

Amundson, K., et al., "Flexible, Active-Matrix Display Constructed Using a Microencapsulated Electrophoretic Material and an Organic-Semiconductor-Based Backplane", SID 01 Digest, 160 (Jun. 2001).

Au, J. et al., "Ultra-Thin 3.1-in. Active-Matrix Electronic Ink Display for Mobile Devices", IDW'02, 223 (2002).

Bach, U., et al., "Nanomaterials-Based Electrochromics for Paper-Quality Displays", Adv. Mater, 14(11), 845 (2002).

Bouchard, A. et al., "High-Resolution Microencapsulated Electrophoretic Display on Silicon", SID 04 Digest, 651 (2004).

Caillot, E. et al. "Active Matrix Electrophoretic Information Display for High Performance Mobile Devices", IDMC Proceedings (2003).

Chen, Y., et al., "A Conformable Electronic Ink Display using a Foil-Based a-Si TFT Array", SID 01 Digest, 157 (Jun. 2001).

Comiskey, B., et al., "An electrophoretic ink for all-printed reflective electronic displays", Nature, 394, 253 (1998).

Comiskey, B., et al., "Electrophoretic Ink: A Printable Display Material", SID 97 Digest (1997), p. 75.

Danner, G.M. et al., "Reliability Performance for Microencapsulated Electrophoretic Displays with Simulated Active Matrix Drive", SID 03 Digest, 573 (2003).

Drzaic, P., et al., "A Printed and Rollable Bistable Electronic Display", SID 98 Digest (1998), p. 1131.

Duthaler, G., et al., "Active-Matrix Color Displays Using Electrophoretic Ink and Color Filters", SID 02 Digest, 1374 (2002).

Gates, H. et al., "A5 Sized Electronic Paper Display for Document Viewing", SID 05 Digest, (2005).

Henzen, A. et al., "An Electronic Ink Low Latency Drawing Tablet", SID 04 Digest, 1070 (2004).

Henzen, A. et al., "Development of Active Matrix Electronic Ink Displays for Handheld Devices", SID 03 Digest, 176, (2003).

Henzen, A. et al., "Development of Active Matrix Electronic Ink Displays for Smart Handheld Applications", IDW'02, 227 (2002).
Jacobson, J., et al., "The last book", IBM Systems J., 36, 457 (1997).
Jo, G-R, et al., "Toner Display Based on Particle Movements", Chem. Mater, 14, 664 (2002).
Johnson, M. et al., "High Quality Images on Electronic Paper Displays", SID 05 Digest, 1666 (2005).
Kazlas, P. et al., "Card-size Active-matrix Electronic Ink Display", Eurodisplay 2002, 259 (2002).
Kazlas, P., et al., "12.1" SVGA Microencapsulated Electrophoretic Active Matrix Display for Information Applicances", SID 01 Digest, 152 (Jun. 2001).
Kitamura, T., et al., "Electrical toner movement for electronic paper-like display", Asia Display/IDW '01, p. 1517, Paper HCS1-1 (2001).
O'Regan, B. et al., "A Low Cost, High-efficiency Solar Cell Based on Dye-sensitized colloidal TiO2 Films", Nature, vol. 353, Oct. 24, 1991, 773-740.
Pitt, M.G., et al., "Power Consumption of Microencapsulated Electrophoretic Displays for Smart Handheld Applications", SID 02 Digest, 1378 (2002).
Webber, R., "Image Stability in Active-Matrix Microencapsulated Electrophoretic Displays", SID 02 Digest, 126 (2002).
Whitesides, T. et al., "Towards Video-rate Microencapsulated Dual-Particle Electrophoretic Displays", SID 04 Digest, 133 (2004).
Wood, D., "An Electrochromic Renaissance?" Information Display, 18(3), (Mar. 24, 2002).
Yamaguchi, Y., et al., "Toner display using insulative particles charged triboelectrically", Asia Display/IDW '01, p. 1729, Paper AMD4-4 (2001).
Zehner, R. et al., "Drive Waveforms for Active Matrix Electrophoretic Displays", SID 03 Digest, 842 (2003).

* cited by examiner

METHODS FOR DRIVING BISTABLE ELECTRO-OPTIC DISPLAYS

REFERENCE TO RELATED APPLICATIONS

This application claims benefit of copending provisional Application Ser. No. 60/557,094, filed Mar. 26, 2004, and of copending provisional Application Ser. No. 60/560,420, filed Apr. 8, 2004.

This application is related to copending application Ser. No. 10/065,795, filed Nov. 20, 2002 (Publication No. 2003/0137521), which itself claims benefit of the following Provisional Applications: (a) Ser. No. 60/319,007, filed Nov. 20, 2001; (b) Ser. No. 60/319,010, filed Nov. 21, 2001; (c) Ser. No. 60/319,034, filed Dec. 18, 2001; (d) Ser. No. 60/319,037, filed Dec. 20, 2001; and (e) Ser. No. 60/319,040, filed Dec. 21, 2001. The aforementioned copending application Ser. No. 10/065,795 is also a continuation-in-part of application Ser. No. 09/561,424, filed Apr. 28, 2000 (now U.S. Pat. No. 6,531,997), which is itself a continuation-in-part of application Ser. No. 09/520,743, filed Mar. 8, 2000 (now U.S. Pat. No. 6,504,524). The aforementioned application Ser. No. 09/520,743 also claims benefit of provisional Application Ser. No. 60/131,790, filed Apr. 10, 1999.

This application is also related to copending application Ser. No. 10/814,205, filed Mar. 31, 2004 (Publication No. 2005/0001812), which claims benefit of the following Provisional Applications: (f) Ser. No. 60/320,070, filed Mar. 31, 2003; (g) Ser. No. 60/320,207, filed May 5, 2003; (h) Ser. No. 60/481,669, filed Nov. 19, 2003; and (i) Ser. No. 60/481,675, filed Nov. 20, 2003.

This application is also related to application Ser. No. 10/249,973, filed May 23, 2003 (Publication No. 2005/0270261), which is a continuation-in-part of the aforementioned application Ser. No. 10/065,795. application Ser. No. 10/249,973 claims priority from Provisional Applications Ser. No. 60/319,315, filed Jun. 13, 2002 and Ser. No. 60/319,321, filed Jun. 18, 2002. This application is also related to application Ser. No. 10/063,236, filed Apr. 2, 2002 (Publication No. 2002/0180687), and to application Ser. No. 10/879,335, filed Jun. 29, 2004 (Publication No. 2005/0024353). Application Ser. No. 10/879,335 claims priority from provisional Application Ser. No. 60/481,040, filed Jun. 30, 2003, and from provisional Application Ser. No. 60/481,053, filed Jul. 2, 2003.

The entire contents of these copending applications, and of all other U.S. patents and published and copending applications mentioned below, are herein incorporated by reference.

BACKGROUND OF THE INVENTION

This invention relates to methods for driving electro-optic displays, especially bistable electro-optic displays, and to apparatus for use in such methods. More specifically, this invention relates to driving methods which are intended to enable more accurate control of gray states of the pixels of an electro-optic display. This invention is especially, but not exclusively, intended for use with particle-based electrophoretic displays in which one or more types of electrically charged particles are suspended in a fluid and are moved through the liquid under the influence of an electric field to change the appearance of the display.

The term "electro-optic" as applied to a material or a display, is used herein in its conventional meaning in the imaging art to refer to a material having first and second display states differing in at least one optical property, the material being changed from its first to its second display state by application of an electric field to the material. Although the optical property is typically color perceptible to the human eye, it may be another optical property, such as optical transmission, reflectance, luminescence or, in the case of displays intended for machine reading, pseudo-color in the sense of a change in reflectance of electromagnetic wavelengths outside the visible range.

The term "gray state" is used herein in its conventional meaning in the imaging art to refer to a state intermediate two extreme optical states of a pixel, and does not necessarily imply a black-white transition between these two extreme states. For example, several of the patents and published applications referred to below describe electrophoretic displays in which the extreme states are white and deep blue, so that an intermediate "gray state" would actually be pale blue. Indeed, as already mentioned the transition between the two extreme states may not be a color change at all.

The terms "bistable" and "bistability" are used herein in their conventional meaning in the art to refer to displays comprising display elements having first and second display states differing in at least one optical property, and such that after any given element has been driven, by means of an addressing pulse of finite duration, to assume either its first or second display state, after the addressing pulse has terminated, that state will persist for at least several times, for example at least four times, the minimum duration of the addressing pulse required to change the state of the display element. It is shown in published U.S. Patent Application No. 2002/0180687 that some particle-based electrophoretic displays capable of gray scale are stable not only in their extreme black and white states but also in their intermediate gray states, and the same is true of some other types of electro-optic displays. This type of display is properly called "multi-stable" rather than bistable, although for convenience the term "bistable" may be used herein to cover both bistable and multi-stable displays.

The term "impulse" is used herein in its conventional meaning in the imaging art of the integral of voltage with respect to time. However, some bistable electro-optic media act as charge transducers, and with such media an alternative definition of impulse, namely the integral of current over time (which is equal to the total charge applied) may be used. The appropriate definition of impulse should be used, depending on whether the medium acts as a voltage-time impulse transducer or a charge impulse transducer.

Several types of electro-optic displays are known. One type of electro-optic display is a rotating bichromal member type as described, for example, in U.S. Pat. Nos. 5,808,783; 5,777,782; 5,760,761; 6,054,071 6,055,091; 6,097,531; 6,128,124; 6,137,467; and 6,147,791 (although this type of display is often referred to as a "rotating bichromal ball" display, the term "rotating bichromal member" is preferred as more accurate since in some of the patents mentioned above the rotating members are not spherical). Such a display uses a large number of small bodies (typically spherical or cylindrical) which have two or more sections with differing optical characteristics, and an internal dipole. These bodies are suspended within liquid-filled vacuoles within a matrix, the vacuoles being filled with liquid so that the bodies are free to rotate. The appearance of the display is changed by applying an electric field thereto, thus rotating the bodies to various positions and varying which of the sections of the bodies is seen through a viewing surface. This type of electro-optic medium is typically bistable.

Another type of electro-optic display uses an electrochromic medium, for example an electrochromic medium in the form of a nanochromic film comprising an electrode formed at least in part from a semi-conducting metal oxide and a plurality of dye molecules capable of reversible color change attached to the electrode; see, for example O'Regan, B., et al., Nature 1991, 353, 737; and Wood, D., Information Display, 18(3), 24 (March 2002). See also Bach, U., et al., Adv. Mater., 2002, 14(11), 845. Nanochromic films of this type are also described, for example, in U.S. Pat. No. 6,301,038, International Application Publication No. WO 01/27690, and in U.S. patent application 2003/0214695. This type of medium is also typically bistable.

Another type of electro-optic display, which has been the subject of intense research and development for a number of years, is the particle-based electrophoretic display, in which a plurality of charged particles move through a suspending fluid under the influence of an electric field. Electrophoretic displays can have attributes of good brightness and contrast, wide viewing angles, state bistability, and low power consumption when compared with liquid crystal displays. Nevertheless, problems with the long-term image quality of these displays have prevented their widespread usage. For example, particles that make up electrophoretic displays tend to settle, resulting in inadequate service-life for these displays.

As noted above, electrophoretic media require the presence of a suspending fluid. In most prior art electrophoretic media, this suspending fluid is a liquid, but electrophoretic media can be produced using gaseous suspending fluids; see, for example, Kitamura, T., et al., "Electrical toner movement for electronic paper-like display", IDW Japan, 2001, Paper HCS1-1, and Yamaguchi, Y., et al., "Toner display using insulative particles charged triboelectrically", IDW Japan, 2001, Paper AMD 4-4). See also European Patent Applications 1,429,178; 1,462,847; and 1,482,354; and International Applications WO 2004/090626; WO 2004/079442; WO 2004/077140; WO 2004/059379; WO 2004/055586; WO 2004/008239; WO 2004/006006; WO 2004/001498; WO 03/091799; and WO 03/088495. Such gas-based electrophoretic media appear to be susceptible to the same types of problems due to particle settling as liquid-based electrophoretic media, when the media are used in an orientation which permits such settling, for example in a sign where the medium is disposed in a vertical plane. Indeed, particle settling appears to be a more serious problem in gas-based electrophoretic media than in liquid-based ones, since the lower viscosity of gaseous suspending fluids as compared with liquid ones allows more rapid settling of the electrophoretic particles.

Numerous patents and applications assigned to or in the names of the Massachusetts Institute of Technology (MIT) and E Ink Corporation have recently been published describing encapsulated electrophoretic media. Such encapsulated media comprise numerous small capsules, each of which itself comprises an internal phase containing electrophoretically-mobile particles suspended in a liquid suspending medium, and a capsule wall surrounding the internal phase. Typically, the capsules are themselves held within a polymeric binder to form a coherent layer positioned between two electrodes. Encapsulated media of this type are described, for example, in U.S. Pat. Nos. 5,930,026; 5,961,804; 6,017,584; 6,067,185; 6,118,426; 6,120,588; 6,120,839; 6,124,851; 6,130,773; 6,130,774; 6,172,798; 6,177,921; 6,232,950; 6,249,271; 6,252,564; 6,262,706; 6,262,833; 6,300,932; 6,312,304; 6,312,971; 6,323,989; 6,327,072; 6,376,828; 6,377,387; 6,392,785; 6,392,786; 6,413,790; 6,422,687; 6,445,374; 6,445,489; 6,459,418; 6,473,072; 6,480,182; 6,498,114; 6,504,524; 6,506,438; 6,512,354; 6,515,649; 6,518,949; 6,521,489; 6,531,997; 6,535,197; 6,538,801; 6,545,291; 6,580,545; 6,639,578; 6,652,075; 6,657,772; 6,664,944; 6,680,725; 6,683,333; 6,704,133; 6,710,540; 6,721,083; 6,727,881; 6,738,050; 6,750,473; 6,753,999; 6,816,147; 6,819,471; 6,822,782; 6,825,068; 6,825,829; 6,825,970; 6,831,769; 6,839,158; 6,842.279; 6,842,657; and 6,842,167; and U.S. Patent Applications Publication Nos. 2002/0060321; 2002/0063661; 2002/0090980; 2002/0113770; 2002/0130832; 2002/0131147; 2002/0171910; 2002/0180687; 2002/0180688; 2003/0011560; 2003/0020844; 2003/0025855; 2003/0102858; 2003/0132908; 2003/0137521: 2003/0151702; 2003/0214695; 2003/0214697; 2003/0222315; 2004/0012839: 2004/0014265; 2004/0027327; 2004/0075634; 2004/0094422; 2004/0105036; 2004/0112750; 2004/0119681; and 2004/0196215; 2004/0226820; 2004/0233509; 2004/0239614; 2004/0252360; 2004/0257635; 2004/0263947; 2005/0000813; 2005/0001812; 2005/0007336; 2005/0007653; 2005/0012980; 2005/0017944; 2005/0018273; and 2005/0024353; and International Applications Publication Nos. WO 99/67678; WO 00/05704; WO 00/38000; WO 00/38001; W000/36560; WO 00/67110; WO 00/67327; WO 01/07961; WO 01/08241; WO 03/107,315; WO 2004/023195; WO 2004/049045; WO 2004/059378; WO 2004/088002; WO 2004/088395; WO 2004/090857; and WO 2004/099862.

Many of the aforementioned patents and applications recognize that the walls surrounding the discrete microcapsules in an encapsulated electrophoretic medium could be replaced by a continuous phase, thus producing a so-called polymer-dispersed electrophoretic display, in which the electrophoretic medium comprises a plurality of discrete droplets of an electrophoretic fluid and a continuous phase of a polymeric material, and that the discrete droplets of electrophoretic fluid within such a polymer-dispersed electrophoretic display may be regarded as capsules or microcapsules even though no discrete capsule membrane is associated with each individual droplet; see for example, the aforementioned 2002/0131147. Accordingly, for purposes of the present application, such polymer-dispersed electrophoretic media are regarded as sub-species of encapsulated electrophoretic media.

A related type of electrophoretic display is a so-called "microcell electrophoretic display". In a microcell electrophoretic display, the charged particles and the suspending fluid are not encapsulated within microcapsules but instead are retained within a plurality of cavities formed within a carrier medium, typically a polymeric film. See, for example, International Application Publication No. WO 02/01281, and published U.S. Application No. 2002/0075556, both assigned to Sipix Imaging, Inc.

Another type of electro-optic display is an electro-wetting display developed by Philips and described in Hayes, R. A., et al., "Video-Speed Electronic Paper Based on Electrowetting", Nature, 425, 383-385 (2003). It is shown in copending application Ser. No. 10/711,802, filed Oct. 6, 2004 (Publication No. 2005/0151709), that such electro-wetting displays can be made bistable.

Other types of electro-optic materials may also be used in the present invention. Of particular interest, bistable ferroelectric liquid crystal displays (FLC's) are known in the art.

Although electrophoretic media are often opaque (since, for example, in many electrophoretic media, the particles substantially block transmission of visible light through the display) and operate in a reflective mode, many electrophoretic displays can be made to operate in a so-called "shutter mode" in which one display state is substantially opaque and one is light-transmissive. See, for example, the aforementioned U.S. Pat. Nos. 6,130,774 and 6,172,798, and U.S. Pat. Nos. 5,872,552; 6,144,361; 6,271,823; 6,225,971; and 6,184, 856. Dielectrophoretic displays, which are similar to electrophoretic displays but rely upon variations in electric field strength, can operate in a similar mode; see U.S. Pat. No. 4,418,346. Other types of electro-optic displays may also be capable of operating in shutter mode.

An encapsulated or microcell electrophoretic display typically does not suffer from the clustering and settling failure mode of traditional electrophoretic devices and provides further advantages, such as the ability to print or coat the display on a wide variety of flexible and rigid substrates. (Use of the word "printing" is intended to include all forms of printing and coating, including, but without limitation: pre-metered coatings such as patch die coating, slot or extrusion coating, slide or cascade coating, curtain coating; roll coating such as knife over roll coating, forward and reverse roll coating; gravure coating; dip coating; spray coating; meniscus coating; spin coating; brush coating; air knife coating; silk screen printing processes; electrostatic printing processes; thermal printing processes; ink jet printing processes; electrophoretic deposition; and other similar techniques.) Thus, the resulting display can be flexible. Further, because the display medium can be printed (using a variety of methods), the display itself can be made inexpensively.

The bistable or multi-stable behavior of particle-based electrophoretic displays, and other electro-optic displays displaying similar behavior (such displays may hereinafter for convenience be referred to as "impulse driven displays"), is in marked contrast to that of conventional liquid crystal ("LC") displays. Twisted nematic liquid crystals act are not bi- or multi-stable but act as voltage transducers, so that applying a given electric field to a pixel of such a display produces a specific gray level at the pixel, regardless of the gray level previously present at the pixel. Furthermore, LC displays are only driven in one direction (from non-transmissive or "dark" to transmissive or "light"), the reverse transition from a lighter state to a darker one being effected by reducing or eliminating the electric field. Finally, the gray level of a pixel of an LC display is not sensitive to the polarity of the electric field, only to its magnitude, and indeed for technical reasons commercial LC displays usually reverse the polarity of the driving field at frequent intervals.

In contrast, bistable electro-optic displays act, to a first approximation, as impulse transducers, so that the final state of a pixel depends not only upon the electric field applied and the time for which this field is applied, but also upon the state of the pixel prior to the application of the electric field. Furthermore, it has now been found, at least in the case of many particle-based electro-optic displays, that the impulses necessary to change a given pixel through equal changes in gray level (as judged by eye or by standard optical instruments) are not necessarily constant, nor are they necessarily commutative. For example, consider a display in which each pixel can display gray levels of 0 (white), 1, 2 or 3 (black), beneficially spaced apart. (The spacing between the levels may be linear in percentage reflectance, as measured by eye or by instruments but other spacings may also be used. For example, the spacings may be linear in L* (where L* has the usual CIE definition:

$$L^*=116(R/R_0)^{1/3}-16,$$

where R is the reflectance and $R_0$ is a standard reflectance value), or may be selected to provide a specific gamma; a gamma of 2.2 is often adopted for monitors, and where the present displays are be used as a replacement for a monitor, use of a similar gamma may be desirable.) It has been found that the impulse necessary to change the pixel from level 0 to level 1 (hereinafter for convenience referred to as a "0-1 transition") is often not the same as that required for a 1-2 or 2-3 transition. Furthermore, the impulse needed for a 1-0 transition is not necessarily the same as the reverse of a 0-1 transition. In addition, some systems appear to display a "memory" effect, such that the impulse needed for (say) a 0-1 transition varies somewhat depending upon whether a particular pixel undergoes 0-0-1, 1-0-1 or 3-0-1 transitions. (Where, the notation "x-y-z", where x, y, and z are all optical states 0, 1, 2, or 3 denotes a sequence of optical states visited sequentially in time.) Although these problems can be reduced or overcome by driving all pixels of the display to one of the extreme states for a substantial period before driving the required pixels to other states, the resultant "flash" of solid color is often unacceptable; for example, a reader of an electronic book may desire the text of the book to scroll down the screen, and may be distracted, or lose his place, if the display is required to flash solid black or white at frequent intervals. Furthermore, such flashing of the display increases its energy consumption and may reduce the working lifetime of the display. Finally, it has been found that, at least in some cases, the impulse required for a particular transition is affected by the temperature and the total operating time of the display, and by the time that a specific pixel has remained in a particular optical state prior to a given transition, and that compensating for these factors is desirable to secure accurate gray scale rendition.

It has been found that, at least in some cases, the impulse necessary for a given transition in a bistable electro-optic display varies with the residence time of a pixel in its optical state; this phenomenon, which does not appear to have previously been discussed in the literature, hereinafter being referred to as "dwell time dependence" or "DTD", although the term "dwell time sensitivity" was used in the aforementioned Application Ser. No. 60/320,070. Thus, it may be desirable or even in some cases in practice necessary to vary the impulse applied for a given transition as a function of the residence time of the pixel in its initial optical state.

Another problem in driving bistable electro-optic displays is that small residual voltages across the electro-optic medium can persist after a transition waveform. This residual voltage, referred to here as a remnant voltage, can cause a drift in the optical state achieved. This phenomenon is called self-erasing.

The phenomenon of dwell time dependence will now be explained in more detail with reference to the FIG. 1 of the accompanying drawings, which shows the reflectance of a pixel as a function of time for a sequence of transitions denoted $R_3 \rightarrow R_2 \rightarrow R_1$, where each of the $R_k$ terms indicates a gray level in a sequence of gray levels, with R's with larger indices occurring before R's with smaller indices. The transitions between $R_3$ and $R_2$ and between $R_2$ and $R_1$ are also indicated. DTD is the variation of the final optical state $R_1$ caused by variation in the time spent in the optical state $R_2$, referred to as the dwell time The present invention relates to methods for reducing dwell time dependence when driving bistable electro-optic displays.

SUMMARY OF THE INVENTION

In one aspect, this invention provides a (first) method of driving a bistable electro-optic display having at least one pixel which comprises applying to the pixel a waveform V(t) such that:

$$J = \int_0^T V(t)M(T-t)dt \quad (1)$$

(where T is the length of the waveform, the integral is over the duration of the waveform, V(t) is the waveform voltage as a function of time t, and M(t) is a memory function that characterizes the reduction in efficacy of the remnant voltage to induce dwell-time-dependence arising from a short pulse at time zero) is less than about 1 volt sec.

In this first method of the present invention, desirably the integral J is less than about 0.5 volt sec, most desirably less than about 0.1 volt sec. In fact, this integral should be made as small as possible, ideally zero. In one form of this method, the waveform comprises a first pulse having a voltage, polarity and duration, and a second pulse having substantially the same voltage magnitude, a polarity opposite to that of the first pulse and a duration substantially less than that of the first pulse.

In one form of the first method, the integral is calculated by:

$$J = \int_0^T V(t)\exp\left(-\frac{T-t}{\tau}\right)dt \quad (2)$$

where $\tau$ is a predetermined decay (relaxation) time. The predetermined time $\tau$ may be in the range of from about 0.2 to about 2 seconds, desirably in the range of from about 0.5 to about 1.5 seconds, and preferably in the range of from about 0.7 to about 1.3 seconds.

In one form of the first method, the waveform comprises two pairs of pulses, the pulses of each pair having substantially the same voltage magnitude and being of equal duration but opposite in polarity, and the pulses of the second pair having a duration longer than the pulses of the first pair, the two pulse pairs being applied in either of the following orders:

(a) the first pulse of the first pair; the first pulse of the second pair; the second pulse of the second pair; and the second pulse of the first pair.

(b) the first pulse of the first pair; the second pulse of the first pair, the first pulse of the second pair; and the second pulse of the second pair.

In a preferred variant of this approach, the waveform further comprises a third pair of pulses, the pulses of the third pair having substantially the same voltage magnitude and being of equal duration but opposite in polarity, and the pulses of the third pair having a duration shorter than the pulses of the second pair, the three pulse pairs being applied in either of the following orders:

(a) the first pulse of the first pair; the first pulse of the third pair; the second pulse of the third pair; the first pulse of the second pair; the second pulse of the second pair; and the second pulse of the first pair.

(b) the first pulse of the first pair; the first pulse of the third pair; the second pulse of the third pair; the second pulse of the first pair, the first pulse of the second pair; and the second pulse of the second pair.

The memory function M(t) of the first method of the present invention may have various forms. For example, M(t) may equal 1, or M(t) may be a sum of multiple exponential functions, as follows:

$$M(t) = \sum_{k=1}^{N} a_k \exp(-t/\tau_k) \quad (3)$$

where each term in the sum of N exponential terms has amplitude $a_k$ and decay time $\tau_k$.

The first method of the present invention need not be applied to all waveforms of a drive scheme, a term which is used herein to mean a set of waveforms capable of effecting all possible transitions among a set of gray levels. When the first method is applied to a display in which each pixel is capable of displaying at least four gray levels, the absolute value of integral J may be maintained below about 1 volt sec for transitions beginning and ending at one of an inner group of gray levels which does not include the two extreme gray levels, but is not necessarily maintained below about 1 volt sec for other transitions.

The first method of the present invention may be used with any of the types of bistable electro-optic media discussed above. Thus, for example, the method may be used with a display comprising an electrophoretic electro-optic medium comprising a plurality of electrically charged particles in a suspending fluid and capable of moving through the suspending fluid on application of an electric field to the suspending fluid. The suspending fluid may be gaseous or liquid. The electrophoretic medium may be encapsulated, i.e., the charged particles and the suspending fluid may be confined within a plurality of capsules or microcells. The first method may also be used with a display comprising a rotating bichromal member or electrochromic medium.

This invention also provides a (second) method of driving a bistable electro-optic display having at least one pixel which comprises applying to the pixel a waveform V(t) such that:

$$J_d = \int_0^{T+\Delta} V(t)M(T+\Delta-t)dt \quad (4)$$

(where T is the length of the waveform, the integral is over the duration of the waveform, V(t) is the waveform voltage as a function of time t, M(t) is a memory function that characterizes the reduction in efficacy of the remnant voltage to induce dwell-time-dependence arising from a short pulse at time zero, and $\Delta$ is a positive period less than the period T) is less than about 1 volt sec.

In this second method of the invention, $\Delta$ may be smaller than about 0.25 T, desirably smaller than about 0.15 T, and preferably smaller than about 0.10 T.

This invention also provides a (third) method of driving a bistable electro-optic display having at least one pixel capable of displaying at least three different optical states, which method comprises applying to the pixel a set of waveforms V(t) sufficient to cause the pixel to undergo all possible transitions among its various optical states, the waveforms of the set being such that the integral $J_d$: calculated from Equation (4) above (but in which $\Delta$ can be zero) is less than about 40 percent of the transition impulse. The transition impulse is defined as the impulse applied by a single pulse of constant voltage having a magnitude equal to the highest voltage applied by any of the waveforms of the set and just sufficient to drive the pixel from one of its extreme optical states to the other (typically white-to-black or black-to white).

In this third method of the present invention, the integral $J_d$ may be less than about 30 percent, desirably less than about 20 percent, and preferably less than about 10 percent, of the transition impulse of the transition effected.

The second and third methods of the present invention may make use of the same wide range of electro-optic media as the first method, as discussed above.

BRIEF DESCRIPTION OF THE DRAWINGS

As already mentioned, FIG. 1 of the accompanying drawings is a graph showing the variation with time of the optical state of one pixel of a display, and illustrating the phenomenon of dwell time dependence.

DETAILED DESCRIPTION OF THE INVENTION

Figure 1:
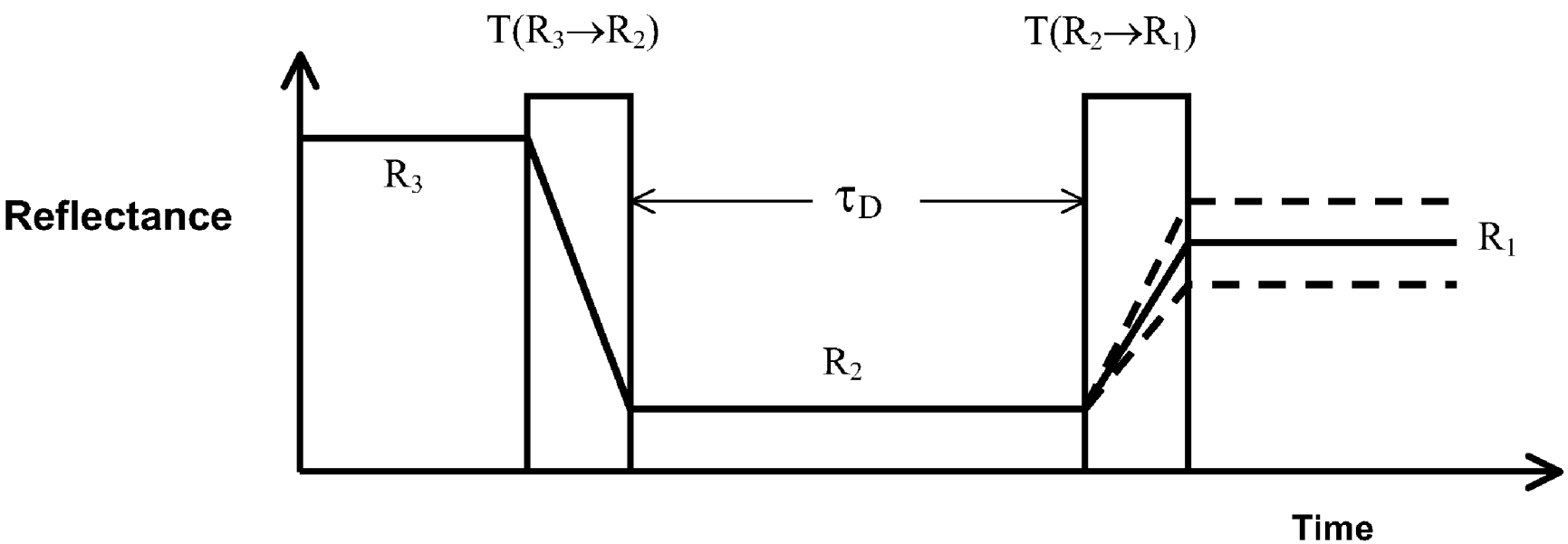

As already mentioned, the present invention provides various methods for driving bistable electro-optic displays, these methods being intended to reduce dwell time dependence (DTD). Although the invention is in no way limited by any theory as to its origin, DTD appears to be, in large part, caused by remnant electric fields experienced by the electro-optic medium. These remnant electric fields are residues of drive pulses applied to the medium. It is common practice to speak of remnant voltages resulting from applied pulses, and the remnant voltage is simply the scalar potential corresponding to remnant electric fields in the usual manner appropriate to electrostatic theory. These remnant voltages can cause the optical state of a display film to drift with time. They also can change the efficacy of a subsequent drive voltage, thus changing the final optical state achieved after that subsequent pulse. In this manner, the remnant voltage from one transition waveform can cause the final state after a subsequent waveform to be different from what it would be if the two transitions were very separate from each other. By "very separate" is meant sufficiently separated in time so that the remnant voltage from the first transition waveform has substantially decayed before the second transition waveform is applied.

Measurements of remnant voltages resulting from transition waveforms and other simple pulses applied to an electro-optic medium indicate that the remnant voltage decays with time. The decay appears monotonic, but not simply exponential. However, as a first approximation, the decay can be approximated as exponential, with a decay time constant, in the case of most encapsulated electrophoretic media tested, of the order of one second, and other bistable electro-optic media are expected to display similar decay times.

Accordingly, the methods of the present invention are designed to use waveforms which produce small remnant voltages and hence low DTD. In accordance with the first method of the present invention, the integral, J, of the product of the waveform and a memory function that characterizes the reduction in efficacy of the remnant voltage to induce DTD, taken over the length of the waveform (see Equation (1) above), is kept below 1 volt sec, desirably below 0.5 volt sec, and preferably below 0.1 volt sec. In fact J should be arranged to be as small as possible, ideally zero.

Waveforms can be designed that give very low values of J and hence very small DTD, by generating compound pulses. For example, a long negative voltage pulse preceding a shorter positive voltage pulse (with a voltage amplitude of the same magnitude but of opposite sign) can result in a much-reduced DTD. Obviously, if needed the polarities of the two pulses could be reversed. It is believed (although the invention is in no way limited by this belief) that the two pulses provide remnant voltages with opposite signs. When the ratio of the lengths of the two pulses is correctly set, the remnant voltages from the two pulses can be caused to largely cancel each other. The proper ratio of the length of the two pulses can be determined by the memory function for the remnant voltage.

As noted above, in a preferred form of the first method of the invention, the memory function represents an exponential decay, cf. Equation (2) above.

For some encapsulated electrophoretic media, it has been found experimentally that waveforms that give rise to small J values also give rise to particularly low DTD, while waveforms with particularly large J values give rise to large DTD. In fact, good correlation has been found between J values calculated by Equation (2) above with $\tau$ set to one second, roughly equal to the measured decay time of the remnant voltage after an applied voltage pulse. There is good reason to believe that other types of bistable electro-optic media will behave similarly, although of course the value of $\tau$ may vary with the exact type of medium used.

Thus, it is advantageous to apply the methods described in the aforementioned patents and applications with waveforms where each transition (or at least most of the transitions in the look-up table) from one gray level to another is achieved with a waveform that gives a small value of J. This J value is preferably zero, but empirically it has been found that, at least for the encapsulated electrophoretic media described in the aforementioned patents and applications, as long as J had a magnitude less than about 1 volt sec. at ambient temperature, the resulting dwell time dependence is quite small.

Thus, this invention provides a waveform for achieving transitions between a set of optical states, where, for every transition, a calculated value for J has a small magnitude. The value of J is calculated by a memory function that is presumably monotonically decreasing. This memory function is not arbitrary but can be estimated by observing the dwell time dependence of a pixel of the display to simple voltage pulse or compound voltage pulses. As an example, one can apply a voltage pulse to a pixel to achieve a transition from a first to a second optical state, wait a dwell time, then apply a second voltage pulse to achieve a transition from the second to a third voltage pulse. By monitoring the shift in the third optical state as a function of the dwell time, one can determine an approximate shape of the memory function. The memory function has a shape approximately similar to the difference in the third optical state from its value for long dwell times, as a function of the dwell time. The memory function would then be given this shape, and would have amplitude of unity when its argument is zero. This method yields only an approximation of the memory function, and for various final optical states, the measured shape of the memory function is expected to change somewhat. However, the gross features, such as the characteristic time of decay of the memory function, should be similar for various optical states. However, if there are significant differences in shape with final optical state, then the best memory function shape to adopt is one gained when the third optical state is in the middle third of the optical range of the display medium. The gross features of the memory function should also be estimable by measuring the decay of the remnant voltage after an applied voltage pulse.

Although, the methods discussed here for estimating the memory function are not exact, it has been found that J values calculated from even an approximate memory are a good guide to waveforms having low DTD. A useful memory function expresses the gross features of the time dependence of the DTD as described above. Thus, the value of $\tau$ in Equation (2) above will vary with the electro-optic medium being used, and may also vary with temperature. For example, a memory function that is exponential with a decay time of one second has been found to work well in predicting waveforms that gave low DTD. Changing the decay time to 0.7 or 1.3 second does not destroy the effectiveness of the resulting J values as predictors of low DTD waveforms. However, a memory function that does not decay, but remains at unity indefinitely, is noticeably less useful as a predictor, and a memory function with a very short decay time, such as 0.05 second, was not a good predictor of low DTD waveforms.

Figure 2:
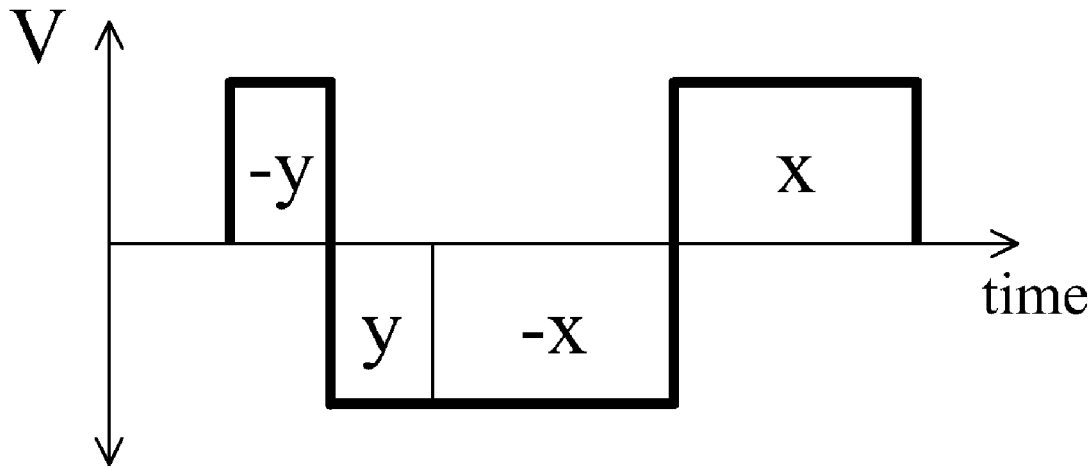
FIGS. 2, 3 and 4 illustrate preferred types of waveform which may be used in any of the three methods of the present invention.
Figure 3:
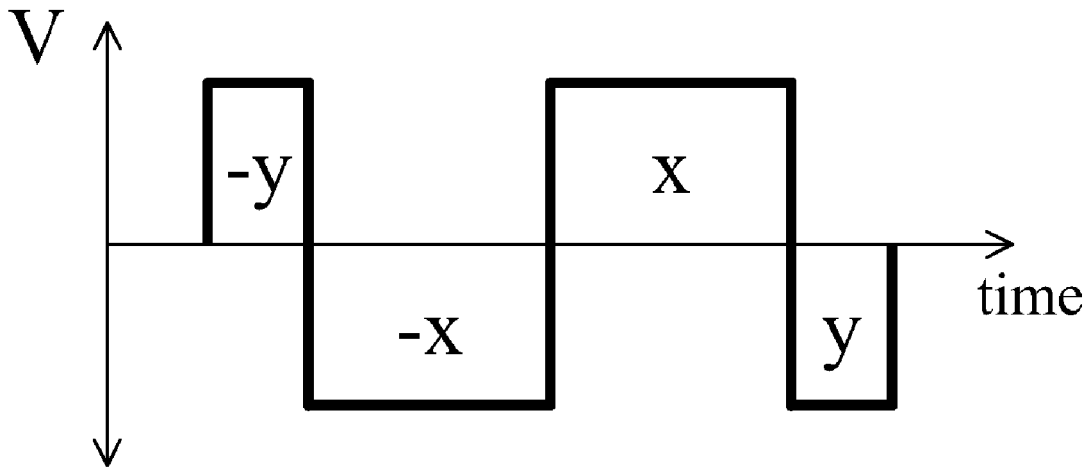
Figure 4:
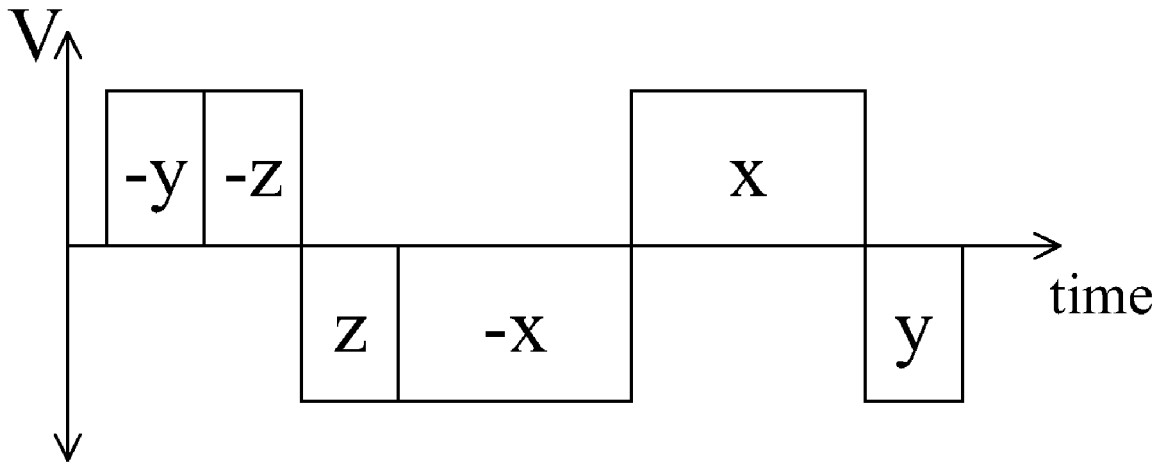

Examples of waveforms that gives a small J value are the waveforms shown in FIGS. 28, 29 and 31 of the aforementioned 2005/0001812 which is reproduced as FIGS. 2, 3 and 4 respectively of the accompanying drawings. The waveform shown in FIG. 2, the first waveform comprises two pairs of pulses (designated the x and y pairs), the pulses of each pair having substantially the same voltage magnitude and being of equal duration but opposite in polarity, and the pulses of the second pair having a duration longer than the pulses of the first pair, the two pulse pairs being applied in the order:

−y, +y, −x, +x, (it being understood that the values of x and y may be negative) where the x and y pulses are all of durations much smaller than the characteristic decay time of the memory function. This waveform functions well when this condition is met because this waveform is composed of sequential opposing pulse elements whose remnant voltages tend to approximately cancel. For x and y values that are not much smaller than the characteristic decay time of the memory function but not larger than this decay time, it is found that that waveforms where x and y are of opposite sign tend to give lower J values, and x and y pulse durations can be found that actually permit very small J values because the various pulse elements give remnant voltages that cancel each other out after the waveform is applied, or at least largely cancel each other out.

FIG. 3 shows a variant of the waveform shown in FIG. 2, in which the +y pulse is transferred from immediately after the −y pulse to the end of the waveform, so that the order of the pulses is:

−y, −x, +x, +y.

FIG. 4 shows a further variant of the waveform shown in FIG. 2. In this variant, the waveform comprises a third pair of pulses (designated "−z" and "+z"). Like the pulses of the first and second pairs, the pulses of the third pair have substantially the same voltage magnitude and are of equal duration but opposite in polarity. The pulses of the third pair also of shorter duration than the pulses of the second pair. The waveform shown in FIG. 4 may be regarded as derived from that shown in FIG. 3 by insertion of the third pair of pulses immediately after the first pulse of the first pair, and thus has the structure:

−y, −z, +z, −x, +x, +y.

The waveform shown in FIG. 2 may similarly be modified by inserting the third pulse pair after the +y pulse, thus producing a waveform of the structure:

−y, +y, −Z, +z, −x, +x.

Equation (1) above relates to the value of the specified waveform integral J at the end of a transition, and the discussion above has focused on maintaining this integral as small as possible. However, it can also be beneficial for an integral be to small a short time after the end of an update. For consideration of this possibility, one can define an alternative integral, $J_d$, according to Equation (4) above. $\Delta$ cannot be arbitrarily large, but must be positive, and less than the update time T. $\Delta$ is desirably smaller than about 0.25 T, and preferably less than 0.15 T, and most preferably less than 0.1 T.

Equation (4), and the second method of the present invention, are based upon the realization that the benefits of reducing remnant voltage are not confined to keeping such voltage small immediately after a transition (small J, as defined by Equation (1)), but may also be realized by making such voltage small a significant time after the end of a transition (small $J_d$, as defined by Equation (4)). This point is especially significant when the memory function is not of a single exponential form, since in such cases, making J small does not guarantee that $J_d$ will be small; perfectly reasonable memory functions can render it very difficult to construct a transition waveform for which J is small, but permit $J_d$ to be easily made small, thus providing substantial benefits.

One preferred memory function, of a single decaying exponential type, for use in the present invention has already been described above with reference to Equation (2). Other useful memory functions include:

(a) $M(t)=1$

This is a special case that equates the J or $J_d$ integral of Equation (1) or (4) to the net voltage impulse of the transition waveform. This special integral may be defined as I where:

$$I = \int_0^T V(t)dt \tag{5}$$

so that J is equivalent to I when the memory function is equal to one at all times. It has been found that dwell state dependence can be substantially reduced by using transition waveforms for which I equals or is close to zero.

(b) The memory function is the sum of multiple exponential decays. In this case the memory function has the form given in Equation (3) above. This memory function is useful because it can better describe the decay of the effect of remnant voltage, for example, after a voltage pulse.

In general, the memory function is a monotonically-decaying function, but it could have other convenient forms, such as the so-called stretched exponential function.

The present invention is not restricted to drive schemes in which the values of J and/or $J_d$ are limited. In some cases, it may be desirable that all transitions have limited J and/or $J_d$. In other cases, it may be difficult to limit J and/or $J_d$ for certain transitions, especially those to or from extreme gray levels, or a mixed mode transition scheme in which only certain transitions have limited J and/or $J_d$ may be desirable for other reasons. The following two cases have been found useful for electro-optic displays having at least four gray levels:

(a) $|I|<\epsilon$ for inner transitions (i.e., transitions in which the initial and final states fall within a limited group of mid gray levels).

The present invention can be practiced with this waveform integral constraint for transitions between $R_j$ and $R_k$ where $R_j$ and $R_k$ belong to a set of mid-gray levels, and this constraint is not necessarily met for transitions between gray levels $R_j$ and $R_k$ when one or both of them do not belong to the mid-gray level set. The mid-gray level set may be the set of all gray levels that are not in either of the extreme quarter of gray levels, i.e. the darkest 25% or the brightest 25% (or equivalent in the case of two-color displays). For example, in a 4-gray level display, the two mid-gray levels are in the mid-gray level set, and the two extreme gray levels are not. In a 32-level gray scale, the mid-gray level set might comprise all except the darkest four and brightest four gray levels.

(b) $|J|<\epsilon$ for inner transitions

In this case, a more general integral constraint is obeyed for the inner transitions, as defined in the previous paragraph.

As already indicated, the present invention relates to reducing the value of the chosen integral, I, J or $J_d$. Although the maximum permissible values of these integrals have been defined above in absolute impulse values (i.e., in terms of volt seconds), in at least some cases it may be more realistic to consider the values of the integrals relative to the magnitude of the transition impulse (as defined above) needed to drive a pixel of the display from one extreme optical state to the other. For example, certain of the E Ink patents and applications mentioned above teach that certain encapsulated electrophoretic media can be driven from one extreme optical state to the other by a 15 V pulse of 300 msec duration. For such a transition, the transition impulse (denoted $G_0$) is 4.5 V sec. For the chosen integral I, J or $J_d$ d for any given transition to be considered small for the purposes of the present invention, this integral should typically be less than about 40 per cent of the transition impulse, desirably less than about 30 per cent of the transition impulse, and preferably less than about 20 per cent of the transition impulse. In very demanding situations, it may even be of value to restrict the value of the integral to less than about 10 per cent of the transition impulse. When each pixel of the display is capable of a large number of gray levels (say eight or more), it will readily be apparent that the values of the chosen integral for certain transitions between closely adjacent gray levels will be small relative to the transition impulse. For example, even if the transition from gray level 4 to gray level 5 in an 8 gray level pixel is effected using only a single drive pulse of constant voltage and polarity, the integral for such a transition will typically be less than 20 per cent of the transition impulse. However, it has been found important to keep the chosen integral small for all transitions of a drive scheme (i.e., a set of waveforms sufficient to effect all possible transitions among the various gray levels of a pixel)) since a remnant voltage produced by one transition may adversely affect one or more subsequent transitions, and hence the present invention provides a method of driving an electro-optic display using such a drive scheme.

This invention can be applied to a wide variety of waveforms and drive schemes. A waveform structure can be devised described by parameters, its J values calculated for various values of these parameters, and appropriate parameter values chosen to minimize the J value, thus reducing the DTD of the waveform.

It will be apparent to those skilled in the art that numerous changes and modifications can be made in the specific embodiments of the present invention described above without departing from the scope of the invention. Accordingly, the whole of the foregoing description is to be construed in an illustrative and not in a limitative sense.

What is claimed is:

1. A method of driving a bistable electro-optic display having at least one pixel which comprises applying to the pixel a waveform V(t) such that:

$$J = \int_0^T V(t)M(T-t)dt$$

is less than about 1 volt sec, where: T is the length of the waveform, the integral is over the duration of the waveform, V(t) is the waveform voltage as a function of time t, and M(t) is a memory function that characterizes the reduction in efficacy of the remnant voltage to induce dwell-time-dependence arising from a short pulse at time zero, the waveform comprising a first pulse having a voltage, polarity and duration, and a second pulse having substantially the same voltage magnitude, a polarity opposite to that of the first pulse and a duration substantially less than that of the first pulse.

2. A method of driving a bistable electro-optic display having at least one pixel which comprises applying to the pixel a waveform V(t) such that:

$$J = \int_0^T V(t)\exp\left(-\frac{T-t}{\tau}\right)dt$$

is less than about 1 volt sec, where: T is the length of the waveform, the integral is over the duration of the waveform, V(t) is the waveform voltage as a function of time t, and M(t) is a memory function that characterizes the reduction in efficacy of the remnant voltage to induce dwell-time-dependence arising from a short pulse at time zero, and $\tau$ is a predetermined decay time in the range of from about 0.2 to about 2 seconds.

3. A method according to claim 2 wherein $\tau$ is in the range of from about 0.5 to about 1.5 seconds.

4. A method of driving a bistable electro-optic display having at least one pixel which comprises applying to the pixel a waveform V(t) such that:

$$J = \int_0^T V(t)M(T-t)dt$$

is less than about 1 volt sec, where: T is the length of the waveform, the integral is over the duration of the waveform, V(t) is the waveform voltage as a function of time t, and M(t) is a memory function that characterizes the reduction in efficacy of the remnant voltage to induce dwell-time-dependence arising from a short pulse at time zero, wherein the waveform comprises two pairs of pulses, the pulses of each pair having substantially the same voltage magnitude and being of equal duration but opposite in polarity, and the pulses of the second pair having a duration longer than the pulses of the first pair, the two pulse pairs being applied in either of the following orders:

(a) the first pulse of the first pair; the first pulse of the second pair; the second pulse of the second pair; and the second pulse of the first pair; or (b) the first pulse of the first pair; the second pulse of the first pair. the first pulse of the second pair; and the second pulse of the second pair.

5. A method according to claim 4 wherein the waveform further comprises a third pair of pulses, the pulses of the third pair having substantially the same voltage magnitude and being of equal duration but opposite in polarity, and the pulses of the third pair having a duration shorter than the pulses of the second pair, the three pulse pairs being applied in either of the following orders:

(a) the first pulse of the first pair; the first pulse of the third pair; the second pulse of the third pair; the first pulse of the second pair; the second pulse of the second pair; and the second pulse of the first pair; and (b) the first pulse of the first pair; the first pulse of the third pair; the second pulse of the third pair; the second pulse of the first pair, the first pulse of the second pair; and the second pulse of the second pair.

6. A method of driving a bistable electro-optic display having at least one pixel which comprises applying to the pixel a waveform V(t) such that:

$$J = \int_0^T V(t)M(T-t)dt$$

is less than about 1 volt sec, where: T is the length of the waveform, the integral is over the duration of the waveform, V(t) is the waveform voltage as a function of time t, and M(t) is a memory function that characterizes the reduction in efficacy of the remnant voltage to induce dwell-time-dependence arising from a short pulse at time zero, M(t) is a sum of multiple exponential functions, as follows:

$$M(t) = \sum_{k=1}^{N} a_k \exp(-t/\tau_k)$$

where each term in the sum of N exponential terms has amplitude $\alpha_k$ and decay time $\tau_k$.

7. A method according to claim 1 wherein each pixel of the electro-optic display is capable of displaying at least four gray levels, and the absolute value of integral J is maintained below about 1 volt sec for transitions beginning and ending at one of an inner group of gray levels which does not include the two extreme gray levels, but is not necessarily maintained below about 1 volt sec for other transitions.

8. A method according to claim 1 wherein the display comprises an electrophoretic electro-optic medium comprising a plurality of electrically charged particles in a suspending fluid and capable of moving through the suspending fluid on application of an electric field to the suspending fluid.

9. A method according to claim 8 wherein the suspending fluid is gaseous.

10. A method according to claim 8 wherein the charged particles and the suspending fluid are confined within a plurality of capsules or microcells.

11. A method according to claim 1 wherein the display comprises a rotating bichromal member or electrochromic medium.

12. A method of driving a bistable electro-optic display having at least one pixel which comprises applying to the pixel a waveform V(t) such that:

$$J_d = \int_0^{T+\Delta} V(t)M(T+\Delta-t)dt$$

is less than about 1 volt sec, where T is the length of the waveform, the integral is over the duration of the waveform, V(t) is the waveform voltage as a function of time t, M(t) is a memory function that characterizes the reduction in efficacy of the remnant voltage to induce dwell-time-dependence arising from a short pulse at time zero, and Δ is a positive period less than the period T.

13. A method according to claim 12 wherein Δ is smaller than about 0.25 T.

14. A method according to claim 13 wherein Δ is smaller than about 0.15 T.

15. A method according to claim 14 wherein Δ is smaller than about 0.10 T.

16. A method of driving a bistable electro-optic display having at least one pixel capable of displaying at least three different optical states, which method comprises applying to the pixel a set of waveforms V(t) sufficient to cause the pixel to undergo all possible transitions among its various optical states, the waveforms of the set all being such that:

$$J_d = \int_0^{T+\Delta} V(t)M(T+\Delta-t)dt$$

is less than about 40 per cent of the transition impulse, where T is the length of the waveform, the integral is over the duration of the waveform, V(t) is the waveform voltage as a function of time t, M(t) is a memory function that characterizes the reduction in efficacy of the remnant voltage to induce dwell-time-dependence arising from a short pulse at time zero, and Δ is a positive period less than the period T, or 0.

17. A method according to claim 16 wherein for all waveforms of the set the integral $J_d$ is less than about 30 percent of the transition impulse.

18. A method according to claim 17 wherein for all waveforms of the set the integral $J_d$ is less than about 20 percent of the transition impulse.

19. A method according to claim 18 wherein for all waveforms of the set the integral $J_d$ is less than about 10 percent of the transition impulse.

20. A method according to claim 4 wherein the display comprises an electrophoretic electro-optic medium comprising a plurality of electrically charged particles in a suspending fluid and capable of moving through the suspending fluid on application of an electric field to the suspending fluid.

21. A method according to claim 20 wherein the suspending fluid is gaseous.

22. A method according to claim 20 wherein the charged particles and the suspending fluid are confined within a plurality of capsules or microcells.

23. A method according to claim 4 wherein the display comprises a rotating bichromal member or electrochromic medium.

* * * * *